United States Patent [19]

Ikemoto et al.

[11] 4,449,829

[45] May 22, 1984

[54] SPEECH SYNTHESIZER TIMEPIECE

[75] Inventors: Yutaka Ikemoto, Shiki-gun; Akira Tanimoto, Kashihara, both of Japan

[73] Assignee: Sharp Kabushiki Kaisha, Osaka, Japan

[21] Appl. No.: 288,331

[22] Filed: Jul. 30, 1981

[30] Foreign Application Priority Data

Jul. 30, 1980 [JP] Japan ..... 55-109099[U]

[51] Int. Cl.³ ..... G04B 21/08

[52] U.S. Cl. ..... 368/63

[58] Field of Search ..... 368/63, 251; 364/710; 179/1 SA, 1 SM

[56] References Cited

U.S. PATENT DOCUMENTS

| | | | |
|---|---|---|---|
| 3,420,051 | 1/1969 | Matteson | 368/63 |
| 3,704,345 | 11/1972 | Coker et al. | 179/15 A |
| 3,835,640 | 9/1974 | Hughes, Jr. | 368/63 |
| 4,259,668 | 3/1981 | Nishimura et al. | 364/710 |

FOREIGN PATENT DOCUMENTS

| | | | |
|---|---|---|---|
| 2911853 | 4/1979 | Fed. Rep. of Germany | 368/63 |

OTHER PUBLICATIONS

Sprechende Uhr, Funkschau, 17/1981, pp. 63-66, Kraekel.

*Primary Examiner*—Bernard Roskoski

*Attorney, Agent, or Firm*—Birch, Stewart, Kolasch & Birch

[57] ABSTRACT

There is disclosed an audio output a device for keeping time, comprising timepiece a memory and a speech synthesizer output for delivering audible messages regarding hours and minutes at an alarm time. The timepiece further includes a first key for sequentially fetching a plurality of words stored in the memory of the speech synthesizer for the delivery of an audible message, and a second key for loading into the memory alarm setting information associated with the words fetched in response to actuation of the first key, wherein the alarm setting and the audible message are outputted when the alarm setting is reached.

2 Claims, 3 Drawing Figures

SPEECH SYNTHESIZER TIMEPIECE

BACKGROUND OF THE INVENTION

This invention relates to a timepiece having an audio output device.

Conventional speech synthesizer timepieces are generally adapted to deliver an audible message such as "it is now 0:00 am" following a chime when an alarm setting is reached. However, in the case that the timepiece has a multiple-stage alarm function but with the common phrase "it's now xxxx" announced at each alarm time, the listener is unable to recognize what the respective alarms mean or suggest.

OBJECTS AND SUMMARY OF THE INVENTION

Accordingly, it is an object of the present invention to provide an audio output timepiece capable of delivering audible messages regarding hours, minutes at an alarm time, wherein an audible accompanying message to be delivered upon reaching an alarm setting is optionally selectable with the user when an alarm time is set.

It is another object of the present invention to provide an audible output timepiece wherein a plurality of alarm-related words or titles are fetched in sequence upon actuation of a specific key (word or message selection key) when alarm settings are to be introduced and a desired one of these words can be loaded upon actuation of another specific key (set key) when said desired one of the words is fetched.

For the purpose of the present invention, the alarm-related words typically include "wake-up", "report", "go-out", "meeting", "guest", "telephone", "business trip", "break time", "opening time of business", "closing time of business", "date", "leisure time", "travel", "private school", "television", "assignment", "play", "shopping", "medicine", "laundry", "birthday", "wedding aniversary" and so forth. For example, the "wake-up" message may bear such sentences as "good morning, it is now 0:00. Please hurry"

BRIEF DESCRIPTION OF THE DRAWINGS

The present invention will be better understood from the detailed description given hereinbelow and the accompanying drawings which are given by way of illustration only.

DETAILED DESCRIPTION OF THE INVENTION

Figure 1:
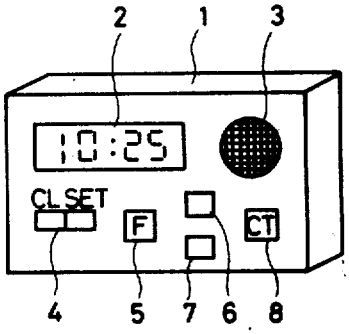
FIG. 1 is a perspective view of the appearance of an audio output timepiece according to an embodiment of the present invention.

Referring now to FIG. 1, there is illustrated an audio output timepiece according to an embodiment of the present invention, which includes a timepeice body 1, a display 2, a loudspeaker 3, a mode swith 4 for selection of timepiece (CL) mode or setting (SET) mode, a time-setting advance key 5, a real-time setting key 6, an alarm time setting key 7 and a message selection key 8.

The illustrated timepiece operates in the following manner. When the message actuated key 8 is selected once after an alarm time is set in the setting mode, a word "wake-up" delivered in the form of synthesized human voice. Upon second actuation of the message selection key 8, an audible annoucment "report" is delivered. Similarly, each time the message selection key 8 is actuated, words such as "meeting" and "break time" previously stored in a ROM in the timepiece are fetched one by one. When a desired one of these words, for example, "break time" has been annouced, then the "setting" key is actuated and information as to "break time" is loaded into the timepiece as well as an alarm setting. Therefore, an audible message "it's now 0:00. Time to take a break" following a chime when the alarm setting is reached.

Figure 2:
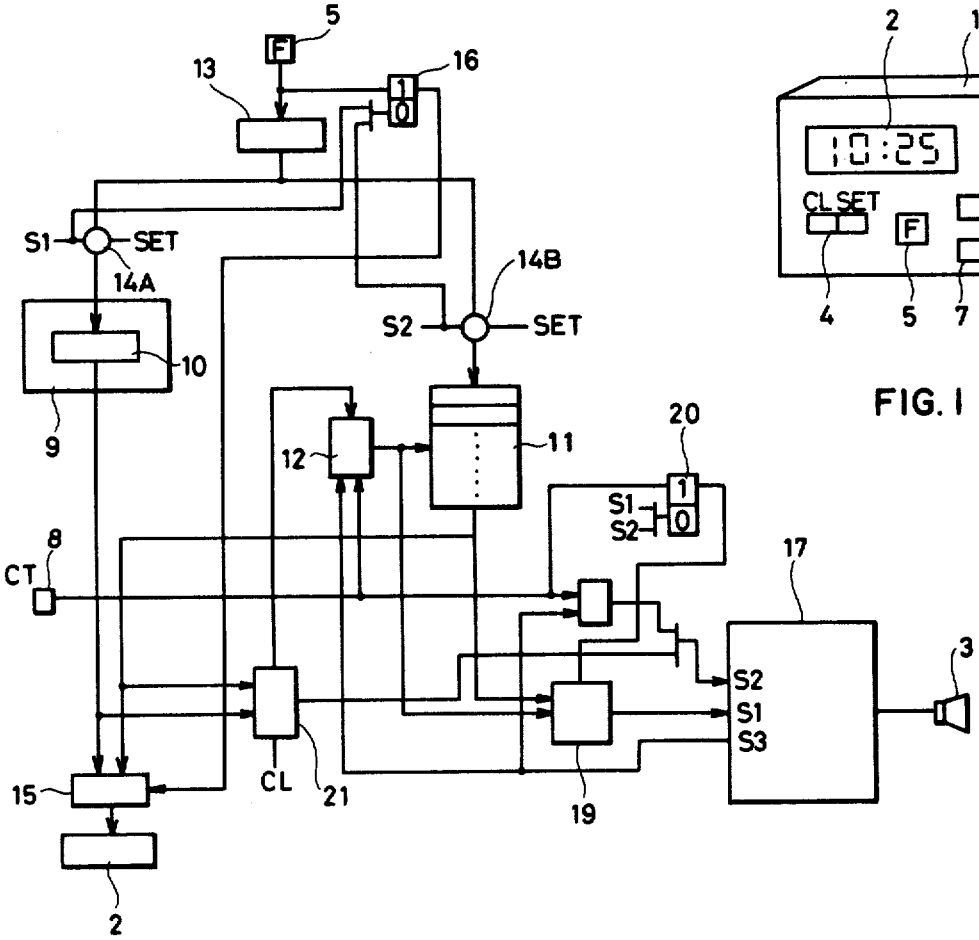
FIG. 2 is a circuit block diagram of the embodiment shown in FIG. 1.

FIG. 2 is a circuit block diagram of the above illustrated embodiment. The display 2, the loudspeaker 3, the time-setting advance key 5 and the message selection key 8 are similar to those in FIG. 1. There is further provided timepiece electronics 9, a real-time counter 10, an alarm time memory 11, an address selector 12 for the memory 11, a time-setting register 13, gate circuits 14A and 14B, a display selection circuit 15, a flip flop 16 storing the kind of visual display, a speech synthesizer circuit 17, a delay control 18, a code converter 19, a flip flop 20 storing whether the timepiece is in the message selection mode, and an alarm time detector 21. Within such an arrangement, a word seleact signal $S_1$, a word start signal $S_2$ and a word end signal $S_3$ are developed.

Figure 3:
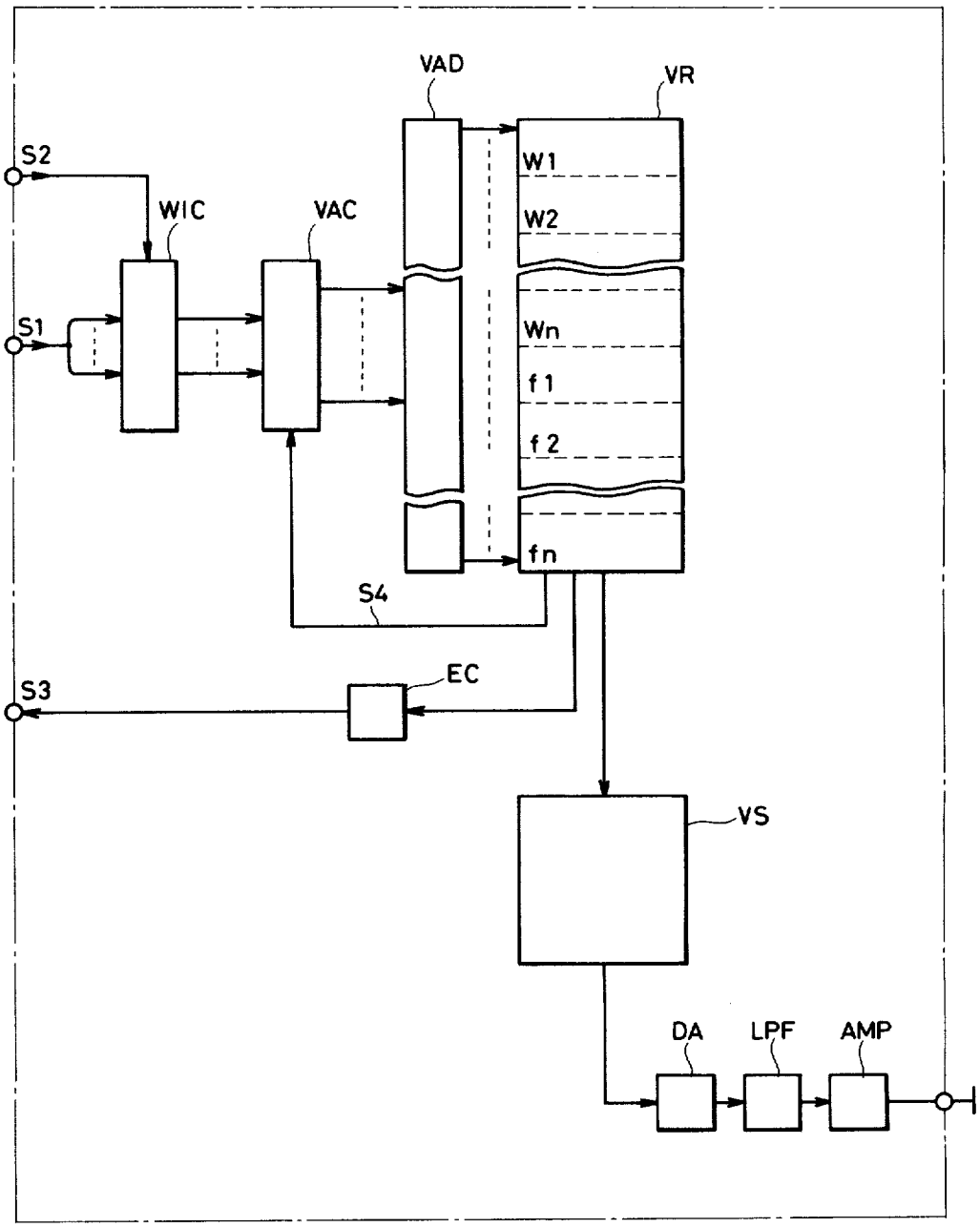
FIG. 3 is a block diagram a speech synthesizer circuit.

FIG. 3 shows the internal structure of the speech synthesizer circuit 17. A memory VR stores word data $W_1$ and so forth and phoneme data $f_1$ and so forth. The word data are ones that indicate what phoneme data are to be used to build up a human sound characteristic of a specific word as well as how to combine these phoneme data. Incoming encoded word select signals $S_1$ are fed to a word initial address selection circuit WIC. The encoded signals $S_1$ are encoded in binary notation each corresponding to a respective one of the words $W_1$ and so forth. The signals $S_1$ are temporarily stored in the word initial address selection circuit WIC and converted into word initial address signals for an address counter VAC when the word start signal $S_2$ is received.

The word initial address signals are representations of the initial addresses of the respective word data $W_1$ and so forth stored within the memory VR. These addresses introduced into the address counter VAC specify the initial addresses for their associated word data. Once the initial address of specific word data has been specified, a string of addresses of that word data and addresses of its associated phoneme data are properly set up in response to an address control signal $S_4$.

A speech data synthesis circit VS receives selected ones of the phoneme data corresponding to the selected word and converts them into signals appropriate for the buildup of human voices. The output of the synthesis circuit VS is fed to the loudspeaker SP through a digital-to-analog converter DA, a low pass filter LPF and an amplifier AMP for the delivery of an audible message. Each of the words consists of a plurality of phonemes and thus is made audible via the loudspeaker SP through combination of the plurality of phonemes corresponding to its associated word data.

A word end signal END is located at the end of each of the word data and is sensed through a word end detector EC which in turn provides the word end signal $S_3$.

It is already noted that of the respective word data $W_1$, $W_2$ and so forth is a minimum unit of words. When it is desired to deliver audibly a full sentence consisting of these words, the word select signal $S_1$ and the word start signal $S_2$ are introduced again to the synthesis circuit in response to the development of the signal $S_3$ related to the preceding word. This procedure is repeated. If necessary, a pause where an audible sound is inhibited is placed to enhance fidelity. Some of the above mentioned word data $W_1$, $W_2$ and so forth have data effective to delay the delivery of voice.

The audio output timepiece in the setting mode operates in the following manner. Upon depression of the key 8 the address selector 12 is placed into a first state at an address for a first alarm setting. Introduction of the word start signal $S_2$ to the speech synthesizer circuit 17 is deferred until the address setting is completed. The flip flop 20, on the other hand, is placed into the set state upon depression of the key 8, indicating that the timepiece is in the message select mode. The output of the flip flop in the set state enables the code converter 19 to transfer the word select signal $S_1$ from the memory 11 to the speech synthesizer circuit 17. The address of the address selector 12 corresponds to any one of the message titles "wake-up", "report", etc., which title is loaded into the speech synthesizer circuit as sound data with the word select signal $S_1$. In other words, the code converter 19 converts the address value into a message selection code. If the key 8 is actuated under these circumstances, then the message title corresponding to the first alarm setting is audibly announced. Upon subsequent actuations of the key 8 the address selector 12 is stepped one by one in response to the word end signals $S_3$, thus fetching audible indications of the message titles or definitions in sequence. If the user listens to a message title of interest, then he depresses the key 7 so that the signal $S_2$ is developed and an alarm time is unloaded from the register 13 into the memory 11 at the address corresponding to that message. It therefore is possible to load a plurality of alarm times and its associated message titles in this manner.

In the timepiece mode, the alarm time detector 21 periodically checks the address selector 12 in the memory 11 to determine whether the real time is in agreement with any one of the alarm settings. If both agree, then the speech synthesizer circuit 17 receives the signal $S_2$ and the output of the memory 11 and the code converter 19 provides controls for the delivery of an audible message "it's now 0:00". After the delivery of such message the converter also provides controls for the subsequent delivery of a message "it's time to xxx". Therefore, a plurality of full messages can be delivered, for example, "it's now 0:00, it's time to xxx".

The audio output timepiece according to the present invention provides audible messages with titles to provide convenience to the user as well as other listeners in recognizing the purpose and meaning of the alarm settings. Moreover, it is also possible to load a plurality of the alarm-related words by merely actuating of the common set key and the message select key in a circuit requiring a minimum of circuit element expenditure.

The invention being thus described, it will be obvious that the same may be varied in many ways. Such variations are not to be regarded as a departure from the spirit and scope of the invention, and all such modifications and intended to be included within the scope of the following claims.

What is claimed is:

1. An audio output timepiece comprising:

timekeeping means;

means associated with said timekeeping means for setting a plurality of alarm times;

speech synthesizer output means for delivering audible indications of hours and minutes at each of said alarm times;

memory means for storing data representing a plurality of additional messages;

means associated with said memory means and said speech synthesizer output means for further delivering a selected one of said additional messages at each of said alarm times; and selector means associated with said memory means and said speech synthesizer means for delivering a verbal indication of each of said additional messages and for selecting respective ones of said additional messages to be delivered at said alarm times.

2. An audio output timepiece comprising:

timekeeping means;

means associated with said timekeeping means for setting a plurality of alarm times and for providing information representing said alarm times;

speech synthesizer output means for delivering audible indications of hours and minutes at each of said alarm times;

memory means for storing data representing a plurality of additional messages;

first means for sequentially fetching said data representing said additional messages; and second means for associating data representing a selected additional message fetched by said first means with information representing one of said alarm times;

wherein said speech synthesizer output means further delivers an audible indication of a selected additional message at each of said alarm times.

* * * * *